US008378573B2

(12) United States Patent
Kontani et al.

(10) Patent No.: US 8,378,573 B2
(45) Date of Patent: Feb. 19, 2013

(54) HIGH PRESSURE DISCHARGE LAMP

(75) Inventors: Toru Kontani, Hyogo (JP); Kazuhiro Goto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 70 days.

(21) Appl. No.: 12/628,452

(22) Filed: Dec. 1, 2009

(65) Prior Publication Data

US 2010/0134003 A1 Jun. 3, 2010

(30) Foreign Application Priority Data

Dec. 1, 2008 (JP) ..... 2008-305819

(51) Int. Cl.
*H01J 17/18* (2012.01)
*H01J 17/04* (2012.01)

(52) U.S. Cl. ..... 313/623; 313/631

(58) Field of Classification Search ..... 313/309, 313/351, 574, 623, 631
See application file for complete search history.

(56) References Cited

U.S. PATENT DOCUMENTS 6,489,723 B2 12/2002 Miyanaga
6,683,413 B2 1/2004 Okubo et al.
2003/0020403 A1* 1/2003 Okubo et al. ..... 313/574
2008/0185950 A1 8/2008 Claus et al.
2010/0156293 A1* 6/2010 Ishikawa et al. ..... 313/631

FOREIGN PATENT DOCUMENTS

JP 2001-319617 A 11/2001
JP 2003-123688 A 4/2003
JP 2004-039496 A 2/2004
JP 2007-188802 A 7/2007
JP 2007-287387 A 11/2007
JP 2008-529252 A 7/2008
JP 2008-235128 A 10/2008

* cited by examiner

*Primary Examiner* — Karabi Guharay
*Assistant Examiner* — Michael Santonocito
(74) *Attorney, Agent, or Firm* — Rader, Fishman & Grauer PLLC

(57) ABSTRACT

A high pressure discharge lamp has an electric discharge container with sealing portions formed at both ends of a light emission section, and electrodes made of tungsten. The electrode has a base end which is buried in the sealing portion. Tips of the electrodes face each other in the light emission section. Purity of the tungsten is 99.99% or more. The electrode has a large diameter portion formed at the tip of the electrode and an axis portion whose diameter is smaller than that of the large diameter portion. A part of a surface of the large diameter portion has a concavo-convex structure where a portion having grooves in a circumference direction and a portion having no groove are asymmetrically formed with respect to an axis of the electrode.

4 Claims, 6 Drawing Sheets

10

HIGH PRESSURE DISCHARGE LAMP

CROSS-REFERENCES TO RELATED APPLICATION

This application claims priority from Japanese Patent Application Serial No. 2008-305819 filed Dec. 1, 2008, the contents of which are incorporated herein by reference in its entirety.

TECHNICAL FIELD

The present invention generally relates to a high pressure discharge lamp, which is used for a data projector, a liquid crystal projector, or a DLP (Digital Light Processor) projector. Specifically, the present invention relates to a high pressure discharge lamp in which mercury of 0.15 mg/mm$^3$ or more is enclosed in a light emitting portion, and the vapor pressure of the mercury goes up to 110 pressure atmosphere.

BACKGROUND

In recent years, a liquid crystal projector and a DLP projector, which are both based on digital light processing technology, are widely used. Either a short arc type metal halide lamp or a short arc type high pressure discharge lamp could be used as a light source for image projection. FIG. 6 is an explanatory cross sectional view of the structure of a high pressure discharge lamp 10. The high pressure discharge lamp 10 has a spherical light emission section 4 formed in a central part thereof and sealing portions 5 formed at both ends of the light emission section 4. A pair of electrodes 11 are arranged inside the light emission section 4. In each sealing portion 5, part of the electrode 11, and a metallic foil 6, which is connected to a base end of the electrode 11, are buried, thereby forming an airtightly sealed structure. In such a high pressure discharge lamp 10, it is possible to suppress a spread of an arc by making the mercury vapor pressure thereof high at time of lighting. It is also possible to further increase an optical output.

However, since the light transmission of the light emission section 4 of the high pressure discharge lamp 10 falls as lighting time passes, there is a problem that an illuminance maintenance rate thereof decreases remarkably. Such illuminance maintenance rate decreases are deemed to be mainly caused by a blackening of the light emission section 4, which is caused when tungsten (a structure material that evaporates at time of lamp lighting) adheres to an inner wall of the light emission section 4. Therefore, as disclosed in a Japanese Patent Application Publication No. 2001-319617, the purity of tungsten of such electrodes 11 is increased to 99.99% or more, so that even if the lamp is lit for a long time, the light emission section 4 is less likely to easily denitrify, whereby a life span of the high pressure discharge lamp 10 may be lengthened.

SUMMARY

If a high pressure discharge lamp having such electrodes made of tungsten whose purity is 99.99% or more is lighted for hundreds hours, the electrode may break at a base portion. When a broken electrode is studied, it was found that when tungsten of a high purity reaches a high temperature at time of lighting of the high pressure discharge lamp, recrystallization takes place so that crystal grains grow larger. It turned out that the cracks were generated so that cutoff occurred along with grain boundaries. In view of the above problem, it is an object of the present invention to provide a high pressure discharge lamp in which the electrodes are not broken, even though the purity of tungsten is 99.99% or more.

One of aspects of the present invention is a high pressure discharge lamp having: an electric discharge container wherein sealing portions are respectively formed at both ends of a light emission section, and electrodes made of tungsten wherein a base end of each of the electrodes is buried in the sealing portion, tips of the electrodes face each other in the light emission section, and purity of the tungsten is 99.99% or more, wherein at least one of the electrodes has a large diameter portion formed at the tip of the electrode and an axis portion whose diameter is smaller than that of the large diameter portion, wherein part of a surface of the large diameter portion has a concavo-convex structure where a portion having grooves in a circumference direction and a portion having no groove are formed so as to be asymmetrical with respect to an axis of the electrode.

In the high pressure discharge lamp, the concavo-convex structure may be formed up to a boundary between the large diameter portion and the axis portion. In the high pressure discharge lamp according to the first aspect of the present invention, since the concavo-convex structure is formed so that the portion having grooves in a circumference direction and the portion having no groove are formed so as to be asymmetrical with respect to the axis of the electrode, the grain boundary of the tungsten which forms the electrode is formed aslant to the axis of the electrode but not perpendicularly thereto. Therefore, even if, due to vibration of the electrode, tensile stress in a direction parallel to the electrode axis occurs in the surface of the electrode, since the grain boundaries are not formed perpendicular to the direction in which this tension is produced, cracks are unlikely to be produced along with the grain boundaries, so that it is possible to prevent breaking of the electrode.

In the high pressure discharge lamp according to the second aspect of the present invention, when the concavo-convex structure is formed at the boundaries between the large diameter portion and the axis portion where the breaking of the electrode is most likely to occur, the grain boundaries in the tungsten in which there is the boundary of the large diameter portion and the axis portion can be formed aslant (not perpendicular) to the axis of the electrode, so that the cracks are unlikely to be generated along with the grain boundary, whereby it is possible to effectively prevent breaking of the electrode.

BRIEF DESCRIPTION OF THE DRAWINGS

Other features and advantages of the present high pressure discharge lamp will be apparent from the ensuing description, taken in conjunction with the accompanying drawings, in which.

DESCRIPTION

Figure 1:
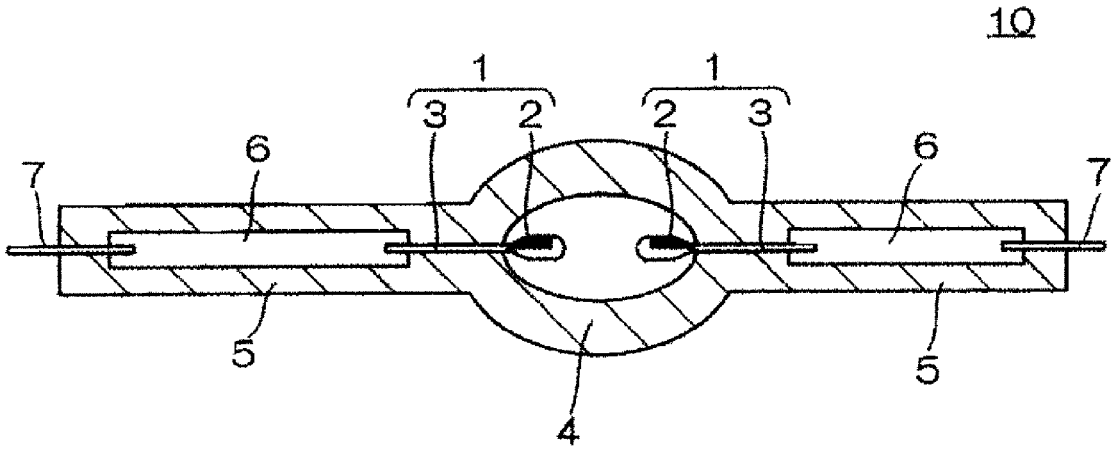
FIG. 1 is an explanatory cross sectional view of the structure of a high pressure discharge lamp according to the present invention.

FIG. 1 is an explanatory cross sectional view of the structure of a high pressure discharge lamp 10 according to a first embodiment. The high pressure discharge lamp 10 has an approximately spherical light emission section 4 made of quartz glass, and a pair of electrodes 1, which face each other, are arranged in the light emission section 4. Moreover, sealing portions 5 are formed so as to extend from the both ends of the light emission section 4. A metallic foil 6 for electric conduction, which is made of molybdenum, is airtightly buried in each of these sealing portions 5, by shrink sealing. An axis portion 3 of each electrode 1 is welded to the metallic foil 6, so as to be electrically connected to each other. Moreover, an external lead 7, which projects to the outside of the sealing portion, is welded to the other end of each metallic foil 6.

Mercury, rare gas, and halogen gas are enclosed in the light emission section 4. The mercury is enclosed in order to obtain a radiation light having wavelength of, for example, 360 nm-780 nm, which is wavelength of the required visible light, and 0.15 mg/mm$^3$ or more of the mercury is enclosed. Although the amount of mercury enclosed therein varies depending on temperature conditions, the amount is set so that the vapor pressure in the light emission section 4 may become very high, for example, 150 or more atmospheric pressure, at time of lighting. Moreover, it is possible to manufacture the high pressure discharge lamp 10 such that at time of lighting the mercury vapor pressure may become 200 atmospheric pressure or more (or 300 atmospheric pressure or more by enclosing more mercury therein). Thus, a light source suitable for a projector apparatus can be realized by making the vapor pressure higher. The rare gas is used to improve a light starting nature, and, for example, argon gas of approximately 13 kPa is enclosed.

The halogen is enclosed in form of a compound of iodine, bromine, chlorine, etc. with mercury or other metal, and the amount of halogen enclosed therein is selected from a range of $1\times10^{-6}$ to $1\times10^{-2}$ μmol/mm$^3$. By enclosing the halogen, a halogen cycle occurs so that the life span of the high pressure discharge lamp 10 can be lengthened. Moreover, as in the high pressure discharge lamp 10 according to the present invention, in case where the size of a lamp is very small and the inner pressure of the lamp is high, there is an advantage that blackening and denitrification of the light emission section 4 can be prevented by enclosing the halogen.

The specification of the high pressure discharge lamp 10 is set forth below. For example, the maximum outer diameters of the light emission section 4 is 11.3 mm, a distance between electrodes is 1.1 mm, and the internal volume of the light emission section 4 is 120 mm$^3$. The high pressure discharge lamp 10 is built in a projector apparatus, so that the high pressure discharge lamp 10 is required to be miniaturized with minimization of the projector apparatus. Moreover, since a high light intensity of the high pressure discharge lamp 10 is required to be high, requiring a high applied electric power, the thermal influence on the inside of the light emission section becomes very severe. The bulb wall loading value (applied electric power per unit area on an inner surface of the light emission section) of the high pressure discharge lamp 10 is 0.8-5 W/mm$^2$, for example, 2.8 W/mm$^2$. The high pressure discharge lamp 10, which has such high mercury vapor pressure and such bulb wall loading value, is built in a presentation apparatus such as a projector apparatus or an overhead projector, thereby generating radiation light with good color rendering properties.

Figure 2A:
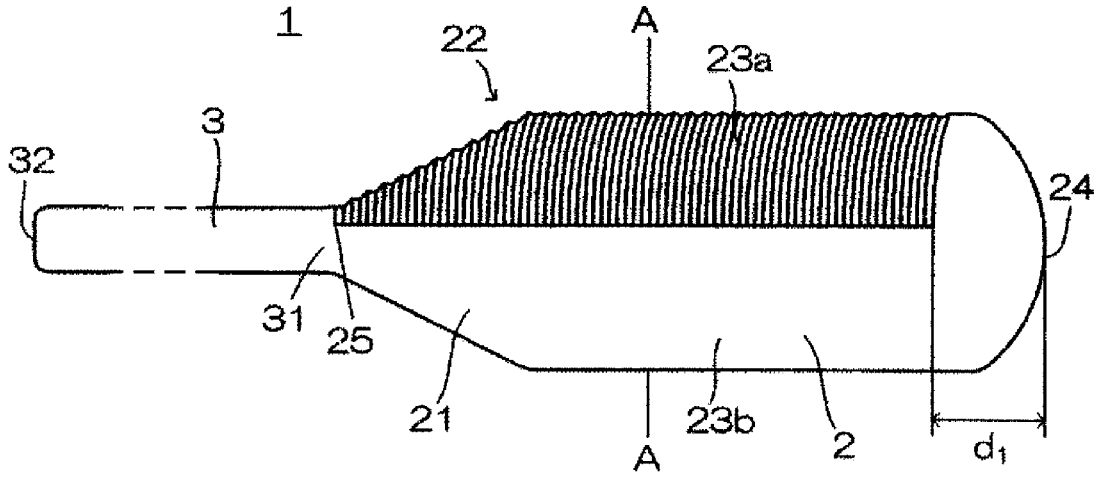
FIGS. 2A and 2B are enlarge views of the structure of an electrode of a high pressure discharge lamp according to the present invention.
Figure 2B:
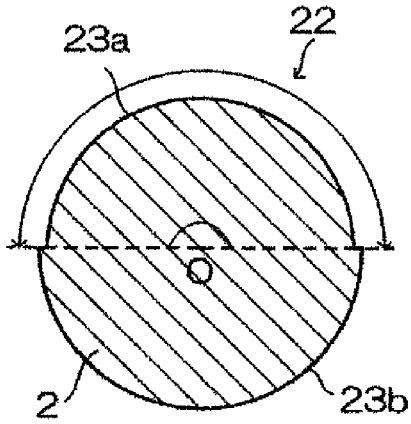

FIGS. 2A and 2B are enlarged structural views of the electrode 1 of the high pressure discharge lamp according to the first embodiment. Specifically, FIG. 2A is a side view of the electrode 1, and FIG. 2B is a cross sectional view thereof taken along a line A-A of FIG. 2A. The electrode 1 is made of tungsten whose purity is 99.99% or more. The axis portion 3, whose diameter is smaller than that of the large diameter portion 2, is integrally formed with the approximately cylindrical large diameter portion 2 so as to extend therefrom. A shrunk portion 21 whose diameter becomes gradually smaller from the large diameter portion 2 to a portion connecting to the axis portion 3, is formed between the large diameter portion 2 and the axis portion 3 so that the large diameter portion 2 is smoothly connected to the axis portion 3. A cylindrical portion, whose diameter is approximately the same and extends from the metallic foil 6 (not pictured), is referred to as the axis portion 3. A portion whose diameter is larger than the axis portion 3 is referred to as the large diameter portion 2. Therefore, the shrunk portion 21 is part of the large diameter portion 2. In addition, although the diameter of the shrunk portion 21 of the large diameter portion 2, which is connected to the axis portion 3, is gradually made smaller in the electrode 1 shown in FIG. 2A, the large diameter portion 2 and the axis portion 3 can also be connected to each other without providing the shrunk portion 21 so that they are connected in a step like shape.

A concavo-convex structure 22 in which grooves extending in a circumference direction of the electrode 1 is formed in part of an outer surface of the large diameter portion 2. The concavo-convex structure 22 extends in an axial direction, to the shrunk portion 21 from a portion at a distance $d_1$ of 1 mm from the tip 24 of the large diameter portion 2, that is, the concavo-convex structure 22 is formed up to a boundary 25 between the large diameter portion 2 and the axis portion 3. The portion 23*a*, where the grooves of the concavo-convex structure 22 are formed, is not formed in the entire circumference of the electrode in the circumference direction thereof, but is formed in part in the circumference direction. Specifically, a circumference portion corresponding to an arc shape in across sectional view of the electrode has a 180 degree central angle O. A portion other than the portion 23*a* where grooves are formed in the circumference direction is referred to as a portion 23*b* having no groove. As shown in FIG. 2A, the portion 23*a* having grooves is formed in an upper side of the electrode, and the portion 23*b* which has no grooves so that the surface thereof is smooth, is formed in a lower side of the electrode, thereby forming the concavo-convex structure 22. That is, in the portion in which the concavo-convex structure 22 of the large diameter portion 2 is formed, the portion 23*a* having grooves and the portion 23*b* having no groove are formed so as to be asymmetrical with respect to the axis of the electrode 1 in the circumference direction.

Since the concavo-convex structure 22 is made up of the portion 23*a* having grooves, and the portion 23*b* having no grooves in part of an outer surface of the large diameter portion 2, the surface area of the portion 23*a* having grooves is larger than that of the portion 23*b* having no groove, so that the surface area in contact with electric discharge space becomes large, whereby heat generated in the electrode 1 can be efficiently radiated thereby maintaining it at a low temperature. Supposing that the electrode 1 could be split into two pieces along with the axial direction, since decrease of the temperature of a half part which includes the portion 23*a* having grooves can be expected due to the large surface area, the temperature thereof becomes lower than that of the other half which includes the portion 23*b* having no grooves.

During lighting of the high pressure discharge lamp, the temperature at the tip 24 of the large diameter portion 2 of the electrode 1, which is closest to an arc, becomes the highest, for example, 4,000 degrees Celsius. The temperature becomes gradually lower from the tip 24 of the large diameter portion 2 toward the shrunk portion 21, and further toward the axis portion 3. Since the base end 32 of the axis portion 3 surrounded by the quartz glass which forms the sealing portion 5 can radiate heat to quartz glass, the temperature thereof is low, for example, 2,000 degrees Celsius.

Since the electrode 1 is heat-treated at temperature of 1,800-2,200 degrees Celsius in the manufacturing process, the temperature of the electrode 1 at time it is used as an electrode of the high pressure discharge lamp is higher than that in the manufacturing process. Therefore, recrystallization of the tungsten, which forms the electrode 1, takes place in the large diameter portion 2 and a portion of the tip 31 of the axis portion 3, so that the crystal grain of the tungsten grows and becomes large, as lighting time of the high pressure discharge lamp becomes long. If the high pressure discharge lamp is lighted for hundreds of hours, some crystal grains are formed in a portion exposed to the electrical discharge space of the electrode 1, so that the grain boundaries, which divide crystal, grains grow.

Moreover, it is thought that the axis portion 3, which is supported by the metallic foil 6, functions as a supporting point at time of lighting of the high pressure discharge lamp, so that the electrode 1 vibrates at short intervals. Since the electrode 1 having the large diameter portion 2, whose volume is large at a tip thereof, bends due to the vibration, tension and contraction always arise in the surface of the electrode 1, in a direction parallel to the electrode axis. Therefore, if the grain boundaries are formed perpendicular to the axis of the electrode 1, that is, perpendicular to the direction in which the tension is produced, since the stress produced by the tension turns into stress which divides the grains along the grain boundaries, it is easy to produce cracks along the grain boundaries, so that the electrode 1 breaks if cracks develop.

However, since the concavo-convex structure 22 on the surface of the large diameter portion 2 of the electrode 1 is made up of the portion 23*a* having grooves where two or more fine grooves whose depth is 100-500 μm (micrometers) and whose interval (between adjacent grooves) is 50-100 μm (micrometers) are formed, and the portion 23*b* having no groove where a smooth face is formed, it is possible to expect positive heat dissipation only from the surface of the portion 23*a* having grooves. For this reason, the temperature of the portion 23*a* having grooves can be kept lower than that of the portion 23*b* having no groove. In the electrode having the concavo-convex structure 22, since recrystallization occurs faster at higher temperatures, crystal grains do not uniformly grow in the axial direction, that is, the crystal grains grow faster in a portion of the electrode near the portion 23*b* having no grooves on the surface, and, slowly in a portion of the electrode near the portion 23*a* having grooves on the surface. Therefore, as for the grain boundaries which divide the crystal grains, a portion of the grain boundaries near the portion 23*b* having no groove on the surface of the electrode is close to the base end 32 of the axis portion 3, and a portion thereof near the portion 23*a* having grooves on the surface is close to the tip 24 of the large diameter portion 2, so that they may be formed not perpendicular but aslant to the axis of the electrode 1.

The concavo-convex structure 22 is formed so that the portion 23*a* having grooves and the portion 23*b* having no grooves are formed so as to be asymmetrical with respect to the axis of the electrode 1 in the circumference direction. Therefore, as to the grain boundaries of the tungsten which forms the electrode 1, the portion thereof near the portion 23*b* having no grooves on the surface, is close to the base end 32 of the axis portion 3, and the portion thereof near the portion 23*a* having grooves on the surface is close to the tip 24 of the large diameter portion 2, so that they may be formed not perpendicular but aslant to the axis of the electrode 1. Therefore, even if tensile stress occurs in the surface due to vibration of the electrode 1, since the grain boundaries are not formed perpendicular to the direction in which the tension is produced, cracks are less likely to be generated along with the grain boundaries, so that it is possible to prevent breaking the electrode 1.

When the concavo-convex structure 22 is formed so as to be long with respect to the axial direction of the electrode 1, since the temperature gradient between the portion in which the concavo-convex structure 22 is formed and the other portion, becomes steep, an angle with respect to a direction perpendicular to the axis of the electrode 1 extending in the direction in which the grain boundaries extend, becomes large, so that it is possible to more effectively prevent breaking of the electrode 1. However, since the tip 24 of the large diameter portion 2 of the electrode 1 becomes very high in temperature at time of lighting, even if the concavo-convex structure 22 is formed on the outer surface of the electrode, it is melted due to the lighting. Therefore, the concavo-convex structure 22 is formed so as to be apart, by at least 1-2 mm, from the tip 24 of the large diameter portion 2 of the electrode 1.

On the other hand, from experiences, it is known that the shrunk portion 21 is often broken. Therefore, especially when the concavo-convex structure 22 is formed on the surface of the shrunk portion 21 which is located in the boundary between the axis portion 3 and the large diameter portion 2, a temperature gradient arises between the portion 23*a* having grooves of the concavo-convex structure 22 of the shrunk portion 21, and the portion 23*b* having no grooves, so that the grain boundaries of tungsten which are formed in the boundary between the axis portion 3 and the large diameter portion 2 are formed not perpendicular to but aslant to the axis of an electrode 1. Therefore, since the grain boundaries are not formed perpendicular to the direction in which tension is produced even if tensile stress occurs in the surface due to vibration of the electrode 1, it is possible to reduce a perpendicular component of stress in the grain boundaries, whereby cracks are less likely to be generated along with the grain boundaries, so that it is possible to effectively prevent breaking the electrode 1.

Figure 3A:
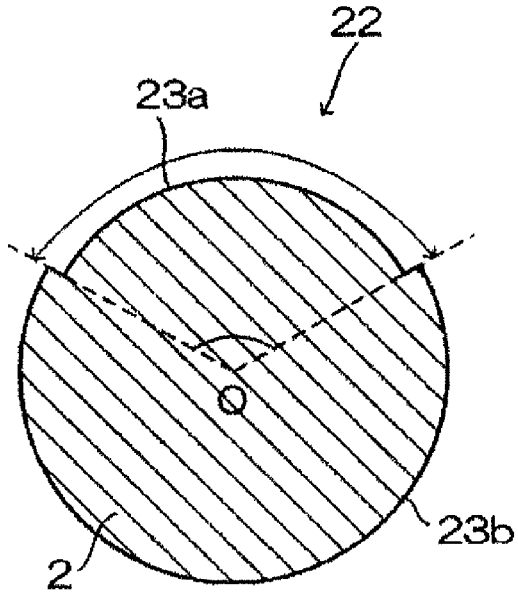
FIGS. 3A and 3B are enlarged cross sectional views of an electrode of a high pressure discharge lamp according to the present invention.
Figure 3B:
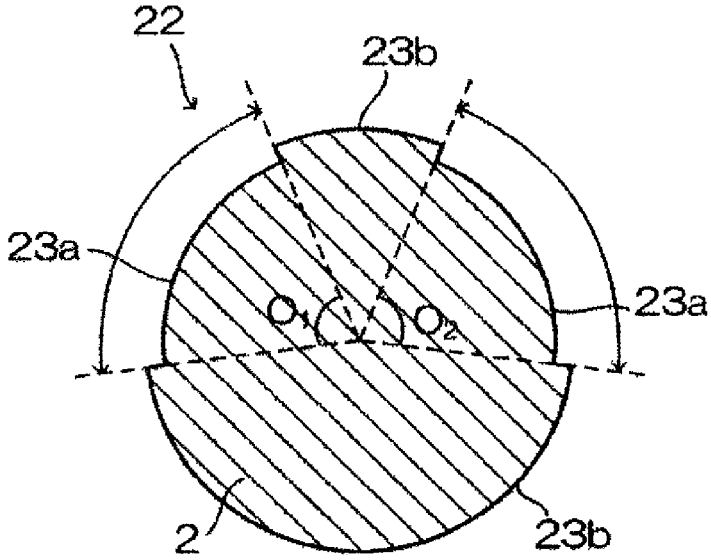

Then, a modified example of the discharge lamp 10 according to the first embodiment will be explained below. FIGS. 3A and 3B are explanatory cross sectional views of a portion of an electrode 1 of the discharge lamp 1 according to the modified example of the first embodiment (FIGS. 2A and 2B), where a concavo-convex structure 22 is formed, wherein the cross sectional views are taken in a direction perpendicular to the axis of the electrode 1. In the electrode 1 shown in the first embodiment (FIGS. 2A and 2B), the concavo-convex structure 22 is formed so that groove portion 23 forms an arc shape in a cross sectional view of the electrode, wherein the central angle O of the arc is 180 degree. However, as shown in FIG. 3A, the central angle of the portion 23*a* having grooves is smaller than that of the electrode 1 shown in the first embodiment, and the concavo-convex structure 22 may be formed by grooves on the electrode whose shape in a cross sectional view thereof is arc, wherein the central angle O thereof is 120-degree, which is 180 degrees or less. Since the concavo-convex structure 22 is formed so that the portion 23*a* having grooves and the portion 23*b* having no grooves may become asymmetrical to the axis of the electrode 1 whereby heat distribution of the electrode 1 does not become uniform, the conditions are fulfilled as long as these grooves are not formed over the entire portion in the circumference direction.

Moreover, as shown in FIG. 3B, grooves may be formed, so as to be divided into two or more portions by the portion 23*b*. Two portions 23*a* having grooves are respectively formed to respectively have an arc shape in a cross sectional view of the electrode and to be apart from each other by an angle of 30 degrees, wherein the central angles $O_1$ and $O_2$ of the arc shape are 80 degrees, respectively. Although the portions 23*a* having grooves are divided into two parts, since the portions 23*a* having grooves are mainly formed in an upper half of the electrode as shown in the figure, positive heat dissipation can be expected from the portions 23*a* having grooves, so that the temperature of the upper half at time of lighting becomes lower than that of the lower half of the electrode where the portion 23*b* having no grooves. Since grain boundaries are formed not perpendicular to but aslant to the axis of the electrode 1, cracks are less likely to be generated along with the grain boundaries so that it is possible to prevent breaking the electrode 1.

Thus, if they are not formed at equal intervals in the circumference direction, two or more sets of the portions 23*a* having grooves, which are divided in the circumference direction may be arranged in the axial direction, and the other portion is formed as the portion 23*b* having no grooves, whose surface is smooth, whereby a concavo-convex structure 22 is formed. However, when the portions 23*a* having grooves are arranged at equal intervals in the circumference direction, since the temperature distribution of the electrode 1 becomes uniform in a section in a diameter direction, such arrangement may be avoided. That is, it is requires that, in the portion in which the concavo-convex structure 22 of the large diameter portion 2 is formed, the portion 23*a* having grooves and the portion 23*b* having no grooves become asymmetrical to the axis of the electrode 1 in the circumference direction.

Figure 4A:
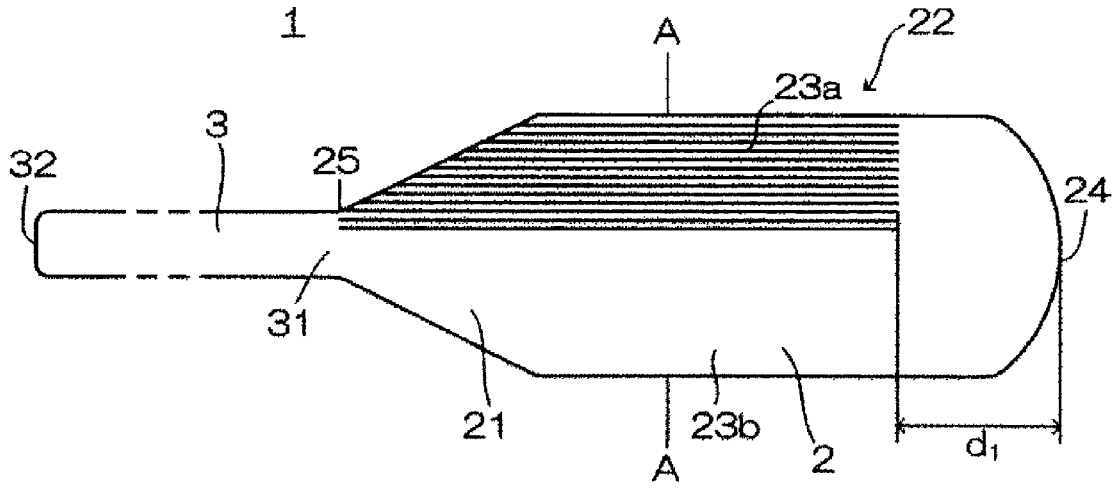
FIGS. 4A and 4B are enlarged views of the structure of an electrode of a high pressure discharge lamp according to the present invention.
Figure 4B:
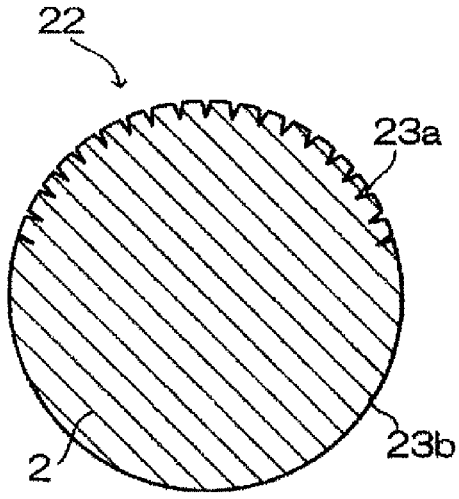

Next, a description of a high pressure discharge lamp according to a second embodiment is given. FIGS. 4A and 4B are enlarged views of the structure of an electrode 1 of the high pressure discharge lamp according to the second embodiment. Specifically, FIG. 4A is a side view of the electrode 1, and FIG. 4B is a cross sectional view thereof taken along a line A-A of FIG. 4A. In the high pressure discharge lamp of the second embodiment, the direction of the grooves of a portion 23*a* of a concavo-convex structure 22 are formed differently from that of the high pressure discharge lamp of the first embodiment. The other structures are generally the same as that of the high pressure discharge lamp of the first embodiment. Descriptions of these elements of the high pressure discharge lamp according to the second embodiment that are the same as those according to the first embodiment are omitted.

In the electrode 1 of the high pressure discharge lamp according to the second embodiment, the portion 23*a* having grooves is formed so that two or more grooves, which extend in the axial direction, are formed over part of the outer surface of the large diameter portion 2. And the concavo-convex structure 22 is formed so that the other portion having a smooth surface is formed as the portion 23*b* having no grooves. The grooves of the portion 23*a* are formed from a portion which is away, by a distance $d_1$ of 1 mm, from the tip 24 of the large diameter portion 2, and are formed so as to extend in the axial direction, up to the shrunk portion 21, that is, up to the boundary 25 between the large diameter portion 2 and the axis portion 3. As shown in FIG. 4B, the portion 23*a* having grooves of the concavo-convex structure 22 is formed in a surface of an upper half of the electrode 1, and a lower half thereof is formed to have a smooth surface as the portion 23*b* having no grooves. That is, in the portion where the concavo-convex structure 22 of the large diameter portion 2 is formed, the portion 23*a* having grooves and the portion 23*b* having no grooves are formed so as to be asymmetrical with respect to the axis of the electrode 1 in the circumference direction.

Since the concavo-convex structure 22 is formed so that the portion 23*a* having grooves and the portion 23*b* having no grooves are formed in the outer surface of the large diameter portion 2, the surface area of the portion 23*a* having grooves becomes larger than that of the portion 23*b* having no grooves, so that the area which is in contact with an electrical discharge space becomes large, whereby heat generated with the electrode 1 can be more efficiently radiated. Therefore, the growth of crystal grain near the portion 23*b* having no grooves on the surface is large, and the growth of crystal grain near the portion 23*a* having grooves on the surface is small, so that the speed of the growth of crystal grain in the portion 23*a* in the axial direction differs from that in the portion 23*b*. Therefore, as to the grain boundaries in the tungsten, which forms the electrode 1, a portion of grain boundaries near the portion 23*b* having no grooves is close to the base end 32 of the axis portion 3, and a portion of grain boundaries near the portion 23*a* having grooves is close to the tip 24 of the large diameter portion 2, so that they may be formed not perpendicular but aslant to the axis of the electrode 1.

Thus, since the grain boundaries are formed not perpendicular but aslant to the direction which tension is produced, even if tensile stress occurs in the surface due to vibration of the electrode 1, cracks are less likely to be generated along with the grain boundaries, so that it is possible to prevent breaking the electrode 1.

As mentioned above, in the first embodiment, the concavo-convex structure 22 including the portion 23*a* having grooves, which are made up of grooves extending in the circumference direction, is formed on the electrode 1, and in the second embodiment, the concavo-convex structure 22 including the portion 23*a* having grooves, which are made up of grooves extending in the axial direction, is formed on the electrode 1. However, the shape of the groove pattern is not limited thereto. That is, for example, the concavo-convex structure may be made up of a grid-like grooves where grooves are formed in both the circumference direction and the axial direction. Moreover, although, in the concavo-convex structure 22 shown in FIGS. 1 to 4B, the portion 23*a* having grooves is formed so as to be located in the upper part of the drawings, the position of the portion 23*a* having grooves is not limited thereto. Even where the portion 23*a* is formed in either lower, right or left part, as long as the portion 23*a* having grooves and the portion 23*b* having no grooves are formed so as to be asymmetrical in the circumference direction, the function of the concavo-convex structure 22 according to the present invention can be achieved thereby.

The shape of crystal grains of the electrode was measured after a high pressure discharge lamp was lighted for 300 hours.

The specification of the high pressure discharge lamp used as an object of the experiment is set forth below. The electric discharge container of the lamp was made of quartz glass. The maximum outer diameter of the light emission section was Φ10.0 mm to 12.0 mm. The full length thereof was 9.0 mm to 11.1 mm. Mercury of 0.15 mg/mm$^3$ or more and bromine gas (halogen) of $1.0\times10^{-6}$ mol/mm$^3$–$1.0\times10^{-2}$ mol/mm$^3$ was enclosed therein. The electrode (purity: 99.99% or higher) was made of tungsten. As to the size thereof, the diameter of the large diameter portion was Φ1.4 mm, and the full length thereof was 5 mm. The diameter of the axis portion was Φ0.5 mm and the full length thereof was 8 mm. The grooves in the concavo-convex structure was formed from a portion at distance of 3 mm from the tip of the large diameter portion, to the boundary between the axis portion and the large diameter portion, wherein the central angle thereof was 180 degrees. The depth of the grooves was 0.1 mm and an interval between grooves was 0.05 mm.

This high pressure discharge lamp was lighted at input power of 330 W where the lamp repeatedly alternated between (firstly) a 100 hours of lighting and (secondly) one hour of lights-off, until the total lighting time reached 300 hours. After the lighting, the electrode was taken out and the crystal grains of the tungsten forming the electrode were observed by a metallograph.

Moreover, a high pressure discharge lamp having the same specification as that of the above described lamp, except that the concavo-convex structure was not formed in the electrode, was prepared as a comparative example. Similarly, the crystal grains of the tungsten were measured a similar repeated lighting set reaching 300 hours.

Figure 5A:
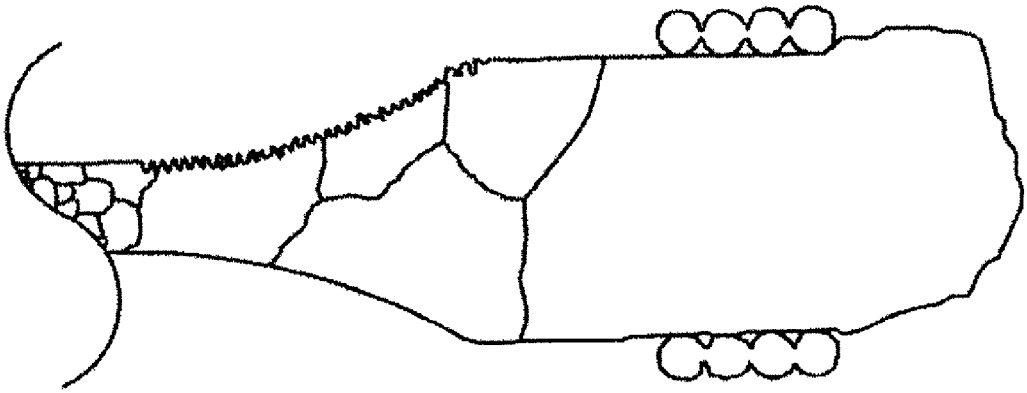
FIGS. 5A and 5B are schematic views of the shape of a crystal grain of the tungsten obtained by an experiment.
Figure 5B:
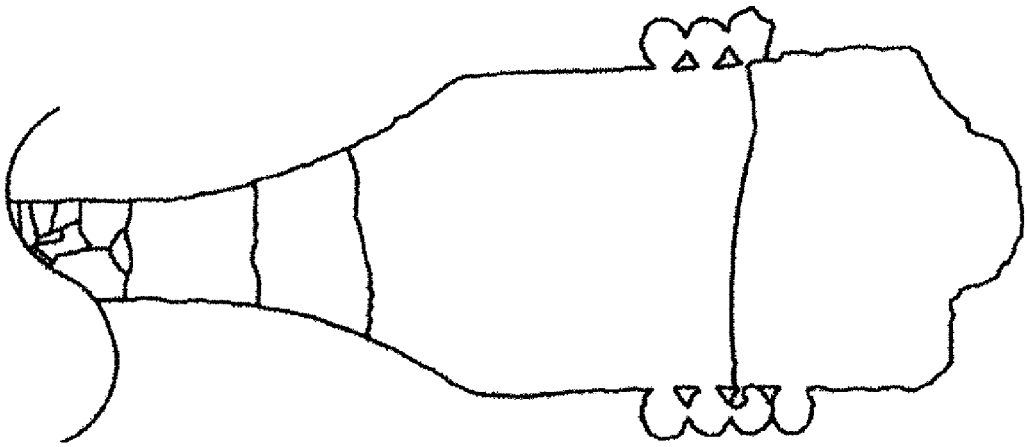
Figure 6:
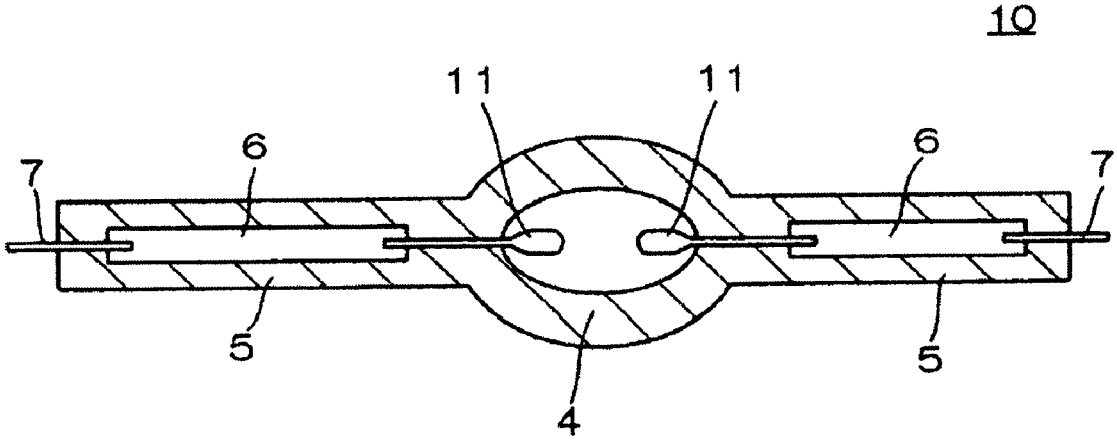
FIG. 6 Prior Art
FIG. 6 is an explanatory cross sectional view of the structure of a conventional high pressure discharge lamp.

FIGS. 5A and 5B are schematic views of the shape of the crystal grains of the tungsten obtained by the experiment. FIG. 5A shows the crystal state in a cross section of the electrode which is the object of the experiment, and FIG. 5B shows the crystal state in a cross section of the electrode according to the comparative example. In the electrode having the concavo-convex structure in which the portion having grooves and the portion having no grooves were asymmetrical with respect to the axis of the electrode in the circumference direction, were formed in part of surface of the large diameter portion, the crystal grains in tungsten of the portion having grooves were small, so that it was possible to confirm the cooling effect (heat dissipation) due to the formation of grooves. Moreover, by the cooling effect (heat dissipation) due to the grooves, the grain boundaries of the tungsten were formed not perpendicular to but aslant to the axis of the electrode, whereby even if tensile stress occurs in the surface thereof in parallel to the electrode axis due to vibration of the electrode, since the grain boundaries were formed not perpendicular to the direction in which tension was produced, it was confirmed that cracks were less likely to be generated along with the grain boundaries, so that it was possible to prevent breaking the electrode.

Moreover, compared with the electrode shown in FIG. 5A, in the electrode of the comparative example in which the concavo-convex structure was not formed, the crystal grains of the tungsten were grown greatly, so that the large diameter portion was made up of three crystal grains, which divide the large diameter portion to three parts in the axial direction. Moreover, since the grain boundaries of the tungsten were formed perpendicular to the axis of the electrode, where tensile stress was produced in parallel to the electrode axis, cracks were produced along with the grain boundaries, it was confirmed that there was a high possibility that the electrode broke.

The preceding description has been presented only to illustrate and describe exemplary embodiments of the present high pressure discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A high pressure discharge lamp comprising:

an electric discharge container that includes a light emission section and sealing portions formed at both ends of the light emission section; and a pair of tungsten electrodes, each of the electrodes comprises a base end, an axis portion, a large diameter portion and a tip;

wherein the base end is buried in the sealing portion, each of the tips of the pair of electrodes faces each other in the light emission section, and purity of the tungsten is 99.99% or more;

wherein the axis portion is smaller than the large diameter portion in diameter, the large diameter portion comprises a concavo-convex structure; and wherein the concavo-convex structure comprises a portion having extending grooves and a portion having no grooves are asymmetrical with respect to the axis of the electrode in the cross sectional view taken in a direction perpendicular to the axis of the electrode; and wherein the portion having extending grooves is extending in an axial direction.

2. The high pressure discharge lamp according to claim 1, wherein the concavo-convex structure is formed at a boundary between the large diameter portion and the axis portion.

3. The high pressure discharge lamp according to claim 1, wherein the grooves are formed in a circumferential direction.

4. The high pressure discharge lamp according to claim 1, wherein the grooves are formed in an axial direction.

* * * * *